United States Patent [19]

Grunwald et al.

[11] Patent Number: 4,950,504

[45] Date of Patent: Aug. 21, 1990

[54] MECHANICAL PLATING WITH OXIDATION-PRONE METALS

[75] Inventors: John J. Grunwald, Ramat Gan; Igal Klein, Karmiel, both of Israel; Bryan Whitmore, New Haven, Conn.

[73] Assignee: MacDermid, Incorporated, Waterbury, Conn.

[21] Appl. No.: 302,108

[22] Filed: Jan. 24, 1989

Related U.S. Application Data

[63] Continuation of Ser. No. 921,961, Oct. 22, 1986, abandoned.

[51] Int. Cl.[5] ..... B05D 3/12; B05D 7/14

[52] U.S. Cl. ..... 427/242; 427/405; 427/406

[58] Field of Search ..... 427/242, 405, 406; 106/1.12

[56] References Cited

U.S. PATENT DOCUMENTS

| | | | |
|---|---|---|---|
| 3,400,012 | 9/1968 | Golben | 427/242 |
| 4,189,525 | 2/1980 | Mori | 428/643 |
| 4,389,431 | 6/1983 | Erismann | 427/242 |
| 4,654,230 | 3/1987 | Coch | 427/242 |

OTHER PUBLICATIONS

Weast, R. C. et al., (editors), *CRC Handbook of Chemistry and Physics*, Boca Raton, Fla., CRC Press, 1985, p. B-7.

*Primary Examiner*—Evan Lawrence

*Attorney, Agent, or Firm*—St. Onge Steward Johnson & Reens

[57] ABSTRACT

In a mechanical plating process, oxidation-prone metals, such as aluminum, titanium, magnesium, and mixtures thereof, can be applied to metal substrates without the corrosion problems encountered in the prior art. To avoid such problems, the substrate is plated with the oxidation-prone metal and relatively minor amounts of an immersion metal and, optionally, a protective metal. The immersion metal which can be salts or oxides of metals selected from the group consisting of tin, copper, nickel, cadmium, zinc, lead, and mixtures thereof coats the oxidation-prone metal in forming a mechanical plating coating and prevents formation of an oxide layer on the oxidation-prone metal. The protective metal which may be selected from the group consisting of zinc, cadmium, and mixtures thereof prevents oxidation of the plated metal substrate when exposed to the environment. An etching agent is used either prior to and/or during mechanical plating.

35 Claims, No Drawings

MECHANICAL PLATING WITH OXIDATION-PRONE METALS

This is a continuation of co-pending application Ser. No. 06/921,961 filed on Oct. 22, 1986, now abandoned.

BACKGROUND OF THE INVENTION

It has been known to plate metal, metal mixtures, and alloys in particulate form on a metal substrate by applying mechanical force sufficient to cause adhesion between the plating metal particles and the surface of the substrate. The mechanical force necessary to cause such adhesion is achieved by placing the plating metal particles, a solid impaction media (e.g. glass or steel beads), materials which promote such plating, and a metal substrate in a rotating ball mill or a tumbling barrel. In this manner, the rotation of the ball mill or the tumbling of the barrel imparts kinetic energy to the impaction media which is transferred to the plating metal particles such that these particles are pounded into the surface of the substrate as a coating.

The early work in this field of mechanical plating was disclosed in U.S. Pat. Nos. 2,640,001, 2,640,002, Re. 23,861, 2,689,808, and 2,723,204 all to Clayton et al. Typically, these mechanical plating processes were undertaken in the presence of a plating liquid containing additives to improve the efficiency of plating and/or the quality of the metal deposited. These additives include surfactants, film-forming materials, antifoaming agents, dispersants, and corrosion inhibitors. Some of these materials are often added together to the plating liquid as a promoter chemical. For example, U.S. Pat. No. 3,460,977 to Golben discloses promoter chemicals with specific surfactants and organic acid materials for mechanical plating. U.S. Pat. No. 3,328,197 to Simon teaches utilizing promoter chemicals in the form of a solid cake or bar which contains a combination of mechanical plating promoter chemicals. As the mechanical plating cycle progresses, the bar or cake dissolves at a rate which provides optimal amounts of promoter chemicals to the mechanical plating process. U.S. Pat. No. 3,268,356 to Simon ("'356 patent") discloses incrementally adding the promoter chemical and/or the plating metal particles to the plating barrel in successive additions to optimize the density and uniformity of the plating metal coating over the entire substrate surface.

In U.S. Pat. No. 3,400,012 to Golben, the advantages of electroplating were sought to be achieved in a mechanical plating process. Such galvanomechanical plating was effected by adding to the plating liquid a "driving" or plating-inducing metal and an ionizable salt of the metal to be plated. The "driving" metal selected is one which is less noble than the plating metal or the metal of the metallic surfaces to be plated. For example, in mechanically plating tin onto steel washers, the plating metal is in the form of tin chloride, and the driving metal is aluminum powder.

U.S. Pat. No. 3,531,315 to Golben ("'315 patent") discloses performing a mechanical plating process in the presence of a strong acid. Prior to the '315 patent, agitation of the plating metal, the impaction media, and the substrate generally was conducted in the presence of weak organic acids such as citric acid. This required that the contents of the plating barrel be rinsed free of any strong acids used to clean or copper the parts before starting the citric acid-based plating process. With the process of the '315 patent, it is possible to conduct the mechanical plating process without need for intermediate rinsing steps, rendering the process extremely economical.

In German Patent No. DE 28 54 159 to Tolkmit, intermediate coatings such as the copper flash coating which is normally applied prior to mechanical plating is applied in a single-stage process from a slurry containing an intermediate coating metal and a final metal.

One form of mechanical plating produces a lighter weight, relatively thin coating of 0.1 to 1.0 mils thick. Another form of mechanical plating, known as mechanical galvanizing, results in the application of a thicker (i.e. from about 1.0 to 5.3 mils) and heavier (i.e. from about 0.7 to 2.5 ounces per square foot) mechanically-applied metallic coating. During the development of such mechanical galvanizing processes, it was found that enhanced adhesion of mechanical galvanizing coatings could be achieved by building up thin layers of mechanically plated metal.

U.S. Pat. No. 4,389,431 to Erisman ("'431 patent") adapted the process of the '315 patent to the incremental metal powder additions of mechanical galvanizing. This was achieved with two chemical promoter systems. The first is a flash promoter which coats the substrate with a thin adherent flash coating of a metal more noble than the plating metal prior to adding the plating metal to the system. The second continuing promoter is then incrementally added with some or all of the incremental additions of a finely divided mechanical plating metal, the layers of which are built up to effect mechanical galvanizing.

Although mechanical plating processes are disclosed as having applicability to any number of malleable metals, metal mixtures, or alloys, certain metals such as aluminum are more difficult to plate in this manner than others. Aluminum has an oxide surface layer which not only is difficult to remove prior to use of aluminum powder in a mechanical plating process but which also reforms readily during the process. This oxide coating inhibits the plating efficiency of aluminum. For example, in mechanically plating metal mixtures containing aluminum powder, it has been found that the aluminum deposits only in very small quantities compared to the other metal powders in the mixture. Similar problems have been encountered in mechanically plating titanium, magnesium, and mixtures containing these metal powders.

As a result of the difficulty in mechanically plating aluminum, other plating technologies had to be used when it was necessary to plate with aluminum. For example, U.S. Pat. No. 3,415,672 to Levinstein et al. coats iron-nickel-cobalt superalloys in a pack-cementation process in which titanium and aluminum are codeposited onto the substrate surfaces from a vapor state (1750° F. to 2150° F.) in the presence of either sodium fluoride, potassium fluoride, or ammonium chloride. In U.S. Pat. No. 3,503,775 to Austin, aluminum coatings are applied to ferrous metal substrates by electrostatic deposition, rolling, and heating. U.S. Pat. No. 3,577,268 to Whitfield et al. coats iron-nickel-cobalt superalloys with an aluminum-magnesium alloy by cementation, dipping, or binder-slurrying procedures.

Some attempts have been made to coat substrates with aluminum by mechanical plating. In U.S. Pat. No. 3,443,985 to Cutcliffe, microscopically smooth, nonmetallic, non-ionizable balls are utilized as an impaction media in coating nails with an aluminum powder alloy of 50% aluminum, 45% tin, and 5% zinc. U.S. Pat. No.

3,754,976 to Babecki et al. sprays a mixture of aluminum and small solid peening particles onto a variety of surfaces at a high velocity. German Offenlegungschrift No. 3,011,662 to Tolkmit describes a mechanical plating process in which the oxide problems with aluminum are said to be obviated by mechanically plating in a liquid containing aluminum, a hydrazine derivative, a polymerization product of propylene oxide and ethylene oxide, and a corrosion inhibitor. The hydrazine apparently releases hydrogen which combines with oxygen residues in the liquid. The activity of aluminum powder is to be maintained by the polymerization product, and, if necessary, further additions of alkali fluorides or fluorosilicates. Although these discoveries permit coating with aluminum, such prior art techniques yield an aluminum coated substrate which is not resistant to corrosion. Due to this problem, the use of light-weight, mechanically-plated, aluminum coatings have been limited. Accordingly, a need exists for a procedure of mechanically plating with aluminum which yields a corrosion resistant product.

SUMMARY OF THE INVENTION

The present invention relates to a process for mechanically plating a metal substrate predominately with an oxidation-prone metal (i.e. a metal which either normally has an oxide surface coating or is prone to development of an oxide coating) such as aluminum. This process achieves not only a high plating efficiency but also yields strongly adherent coatings with improved resistance to corrosive environments.

These improvements are achieved by mechanically plating with different metals in particulate form applied in a variety of sequences to coat the metal substrate with layers of individual metals and/or layers of a plurality of dispersed metals. These metals to be plated on the metal substrate include an oxidation- prone metal, a protective metal, and an immersion metal.

The oxidation-prone metal is normally (i.e. in its typical state) a finely-divided powder for use in a mechanical plating process which has an oxide layer on its surface and is prone to reformation of an oxide surface layer even if any pre-existing oxide layer is removed.

The immersion metal coats the oxidation-prone metal and the substrate during formation of a mechanically plated coating on the metal substrate and minimizes formation of an oxide layer on the oxidation-prone metal during the plating process.

The protective metal prevents oxidation of the plated metal substrate when the substrate is exposed to the environment. Although the protective metal need not be utilized, such utilization is preferred due to its corrosion inhibiting effect.

The etching agent in the aqueous admixture is effective to remove from the finely-divided oxidation-prone metal any surface oxide layer. In an alternative but less preferred embodiment, the finely-divided, oxidation-prone metal can be pretreated with the etching agent and the immersion metal apart from the mechanical plating process, and this pretreated, oxidation-prone metal can then be employed in the mechanical plating process without utilizing an etching agent.

With the present invention, metals such as aluminum which are otherwise difficult to plate mechanically because of their pre-existing oxide coating and their tendency to develop an oxide coating during plating are efficiently plated mechanically on metallic substrates. The coating resulting from such mechanical plating comprises the oxidation-prone metal in a predominate amount, for example, as high as 90% by weight of the coating, with the remainder comprised of the immersion metal(s), any minor impurities, and, optionally, the protective metal.

DETAILED DESCRIPTION OF THE INVENTION

The process of the present invention is generally similar to prior art mechanical plating processes with respect to operating mode and parameters, the impaction media, the surfactants, the dispersant additives, and the corrosion inhibiting agents. Likewise, the apparatus in which the plating process is carried out can be any of the known mechanical plating barrels or mills.

As taught by the '315 patent and the '431 patent, a substrate to be plated is placed in a rotatable plating barrel containing a glass bead impaction media. Water and a strong acid surface conditioner such as sulfuric acid are also added to the barrel and then dispersed by rotation of the plating barrel. As shown in the examples of the '431 patent, for instance, the process according to the '315 patent can optionally include precleaning and rinsing prior to the addition of water and strong acid conditioner. Such precleaning can be effected in the plating barrel or in some other tank by either degreasing with an alkaline cleaner, descaling with an acid cleaner, or both degreasing and descaling. After precleaning, the substrate is rinsed. In accordance with the '315 patent, there is no subsequent draining or rinsing after addition of surface conditioner. Although some oxide scale forms on the substrate between rinsing and the addition of water and strong acid surface conditioner, the sulfuric acid surface conditioner will remove such scale during its dispersion in the rotating barrel. After dispersion of the sulfuric acid surface conditioner and water in the rotating plating barrel containing the substrate and impaction media and without either draining the acid from the plating barrel or rinsing the substrate with water, a coppering agent (e.g. copper sulfate pentahydrate) is added to the plating barrel. This causes copper to be deposited on the surfaces of the substrate which then acts as a base for adhesion of subsequent coatings to the substrate.

A promoter chemical is then added to the plating barrel to provide a proper environment for mechanical plating. In addition, the promoter chemical may also help clean the subsequently-added plating metal powder and control the size of plating metal agglomerates. Suitable promoter chemicals contain a strong acid or acid engendering salt and a salt of a metal which is more noble than the subsequently-added plating metal. Optionally, the promoter can also include a dispersant for the subsequently-added plating metal and/or a corrosion inhibitor. The soluble salts of a metal more noble than the plating metal include cadmium, lead, and preferably tin (e.g. stannous chloride, stannous sulfate). The strong acid or acid engendering salt can be, for example, sulfuric acid, potassium or ammonium bisulfate, sulfamic acid, or sodium bisulfate. The dispersant and the corrosion inhibitor can be any of those disclosed in columns 3–4 of the '315 patent. The promoter contains per 100 square feet of plating surface up to 400 grams of the strong acid or acid engendering salt and from about 10 to about 80 grams of the soluble salt of a metal which is more noble than the plating metal. In addition, effective amounts of dispersant and/or corrosion inhibitor can be added as needed for their intended purposes.

After the promoter is charged to the rotating barrel, plating metal powder is added. The addition of the plating metal powder displaces part or all of the metal of the promoter from the liquid in the plating barrel onto the plating metal and substrate as a flash coating. The rotation of the barrel then causes the glass bead impaction media to strike the substrate such that the plating metal powder is pounded into adherence with the substrate.

Alternatively, the promoter system disclosed by the '431 patent may be used. As noted supra, this system utilizes two promoters—i.e. a flash promoter and a continuing promoter. The flash promoter contains the same ingredients in the same amounts as are used with the promoters described above. The continuing promoter includes per pound of plating metal about 20 to about 150 grams of a strong acid or an acid engendering salt, from about 1 to about 20 grams of a soluble salt of a metal more noble than the plating metal, and optionally, an effective amount of a dispersant capable of dispersing the plating metal and/or an effective amount of an inhibitor capable of inhibiting corrosion of the substrate and the plating metal. The flash promoter is added to the rotating barrel after coppering is completed and before the addition of plating metal powder. The continuing promoter is added with each incremental addition of plating metal .powder added to the rotating barrel. The dual promoter system disclosed in the '431 patent is particularly useful when there is an insufficient amount of inhibitor or dispersant in the barrel prior to completion of mechanical plating. When such deficiencies occur, as can be determined by one of ordinary skill in the art, the continuing promoter can be added. Such additions of continuing promoter may or may not be needed for each addition of particulate plating metal depending on the degree of corrosion and dispersibility in the plating barrel.

For the present invention, the oxidation-prone metal, the immersion metal, and, optionally, the protective metal are all applied to the surface of the metal substrate during mechanical plating and, therefore, function generally as plating metals.

As stated previously, the oxidation-prone metal normally has an oxide layer on its surface which is likely to reform even after descaling. Such metals are more likely to have oxide layers on their surfaces than the protective metal. Examples of these oxidation-prone metals include aluminum, titanium, magnesium, and mixtures thereof with the preferred oxidation-prone metal being aluminum.

The etching agent is any compound or mixture of compounds effective to remove an oxide surface coating from the finely- divided oxidation-prone metal used in the process. Particularly effective in this regard are fluoride compounds such as alkali metal fluorides, ammoniated fluorides, intermetallic fluoride compounds such as $K_2ZrF_6$, and mixtures thereof. The etching agent preferably will have an instability constant smaller than the fluorides of the immersion metal but larger than the fluorides of the oxidation-prone metal to be etched. In processes in which the fluoride is included as an ingredient in the plating liquid (e.g. when the oxidation-prone metal has not been etched or where the oxidation-prone metal was etched without the immersion metal) to effect removal of oxides from the oxidation-prone metal, the concentration of fluoride is generally in the range of from about 1% to about 30% based upon the weight of the oxidation-prone metal present. In those processes in which the oxidation-prone metal powder is treated with the etching agent separate and apart from the plating process per se, generally any suitable concentration of etching agent may be employed.

The immersion metals of the present invention are those metals which coat on or otherwise associate with the finely-divided oxidation-prone metal to minimize formation of an oxide coating during the mechanical plating process. As with the etching agent, the coating of the immersion metal(s) onto the oxidation- prone metal may be effected as part of the mechanical plating process or may be conducted separate from and prior to the actual plating process. Examples of the immersion metal include tin, copper, nickel, cadmium, zinc, lead, and mixtures thereof. These metals are provided in any non-metallic, soluble form such as oxides, salts, sulfates, or the like (e.g. SnO, $CuSO_4$, and $NiSO_4$). In this form, the immersion metal is reduced at the surface of the oxidation-prone metal to its metallic state (i.e. where its oxidation number is zero) and then mechanically applied to the substrate surface. Typically, the concentration of the immersion metal utilized in the plating liquid or in a pretreatment step will be such that the mechanically-plated coating contains at least about 50% by weight of the oxidation-prone metal, with the remainder comprised of the immersion metal(s) and minor impurities (e.g. iron) which are sometimes present. More preferably, the mechanically plated coating will contain at least 65% and preferably at least about 80% of the oxidation-prone metal with the concentration of the immersion metal(s) being adjusted to achieve such results.

According to one embodiment of the invention, the metal substrate is cleaned in accordance with known processes and, if desired, provided with a copper flash in the apparatus in which mechanical plating is to be effected. Finely-divided oxidation- prone metal pretreated in a separate operation with an etching agent to remove oxide surface layers can be further separately pretreated in the presence of one or more immersion metals to protect the oxidation-prone metal against further oxidation and to provide eventually a mechanically plated deposit having the desired percentage of the oxidation-prone metal and the immersion metal(s). The so-treated oxidation-prone metal powder is then added to the mechanical plating apparatus containing the metal substrate, impaction media, and any other additives (e.g. surfactants, dispersants, pH adjusting agents, corrosion inhibitors, driving metals, additional liquid medium, etc.) as may be desired according to known processes. Agitation or tumbling of the apparatus is then conducted for a period of time sufficient to plate the surface of the substrate with the oxidation-prone metal. Such agitation can be either continuous throughout the mechanical plating process or intermittent after each additive is charged into the plating liquid.

In an alternative embodiment, the oxidation-prone metal powder optionally pretreated with etching agent is added to the apparatus without prior treatment with immersion metal(s). The immersion metal and more of the etching agent either may be predissolved in the plating liquid prior to addition of the oxidation-prone metal or may be added at the same time as the oxidation-prone metal or may be both predissolved and added simultaneously with the oxidation-prone metal.

In the preferred embodiment of the present invention, a protective metal in its metallic form is also utilized, as discussed previously, to prevent oxidation of the plated metal substrate during exposure to the environment. Suitable protective metals are more anodic on the galvanic series than iron. Examples of such protective metals include zinc, cadmium, and mixtures thereof. The weight ratio of protective metal to oxidation-prone metal, particularly when using zinc and aluminum, respectively, is 1:99 to 99:1, preferably 1:4 to 4:1.

In carrying out the process of the present invention according to the preferred embodiment noted in the preceding paragraph, the oxidation-prone metal, the protective metal, the immersion metal, and the etching agent can be used in any of a variety of sequences, wherein the sequence of adding the oxidation-prone metal and the protective metal determines the order in which these metals coat the substrate—i.e. the metal first added to the plating liquid forms the first coating layer on the substrate, while the metal added next forms the second coating layer on the substrate, and so on. It is preferred that the etching agent and the immersion metal be added to the plating liquid in the plating barrel rather than being used to pretreat the oxidation-prone metal at some other location. The etching agent can be added at anytime during the mechanical plating process (i.e. before, during, or after addition of the oxidation-prone metal) regardless of the plating sequence. However, the etching agent is preferably added to the plating liquid and dispersed therein prior to addition of the oxidation- prone metal.

The oxidation-prone metal can be added to the plating liquid either together with or after addition of the protective metal. If the oxidation-prone metal and the protective metal are added to the plating liquid simultaneously, a coating layer containing dispersed oxidation-prone metal and protective metal is formed on the metal substrate after the plating liquid is agitated. If the oxidation-prone metal is added to the plating liquid after the protective metal with plating liquid agitation steps being carried out after each addition, the coating on the metal substrate is a layer of oxidation-prone metal around a layer of protective metal.

Coating the substrate with a layer of oxidation-prone metal over a layer of protective metal is especially preferred. In a mechanically plated substrate, pores always formed in the mechanically-applied coating are sealed by the corrosion product of zinc. When aluminum is mechanically plated on a substrate, however, the aluminum is passivated without filling the pores of the coating. Unless, a layer of the protective metal or a codeposited layer of the protective metal with aluminum is present, the corrosive environment can reach the metal substrate.

In either of the 2 previously-stated sequences of plating with the oxidation-prone metal and the protective metal, an immersion metal must be added to the plating liquid either before, after, or during addition of the protective metal and the oxidation-prone metal so that the oxidation-prone metal can plate on the metal substrate. In any of these sequences of adding immersion metal, this metal coats particles of the oxidation-prone metal dispersed in the plating liquid so that plating can occur. In addition, immersion metal particles can also be plated over any already-plated layer containing aluminum to protect the aluminum. Although some of the particles used as immersion metal could plate by themselves on the substrate if added prior to the oxidation-prone metal along with a reducing agent for said immersion metal, this plated metal would not function as an immersion metal, because the purpose of the immersion metal is to minimize oxide formation by forming a barrier coating on the oxidation-prone metal.

For example, the substrate can be coated with a mixture of the oxidation-prone metal, the protective metal, and the immersion metal by simultaneously adding these metals to the plating liquid and agitating this liquid. In addition, another layer of the immersion metal surrounding each particle or aggregate of dispersed immersion metal, protective metal, and oxidation-prone metal can be applied to the substrate. The following sequence is one way of producing such a coating: (1) adding together the protective metal, the oxidation-prone metal, the etching agent, and the immersion metal to the plating liquid containing the substrate and the impaction media; (2) agitating the plating liquid; (3) adding together more of the oxidation- prone metal, the protective metal, and the immersion metal to the plating liquid; (4) agitating the plating liquid; (5) adding more immersion metal to the plating liquid; and (6) agitating the plating liquid.

A layer of dispersed oxidation-prone metal, protective metal, and immersion metal can also be formed by adding immersion metal to the plating liquid, agitating the plating liquid, simultaneously adding oxidation-prone metal and protective metal to the plating liquid, and agitating the plating liquid. In this sequence, the immersion metal in the plating liquid will coat the subsequently-added oxidation-prone metal, and the oxidation-prone metal, the protective metal, and the immersion metal will together plate on the metal substrate.

Alternatively, the substrate can be coated with a layer of dispersed oxidation-prone metal and immersion metal which surrounds a layer of the protective metal by the following sequence of steps: (1) adding the protective metal to the plating liquid containing the metal substrate and the impaction media; (2) agitating the plating liquid; (3) adding together the oxidation-prone metal, the etching agent, and the immersion metal to the plating liquid; and (4) agitating the plating liquid. Alternatively, this coating can be applied by adding simultaneously the protective metal and the oxidation-prone metal to the plating liquid, agitating the plating liquid, adding the immersion metal to the plating liquid, and agitating the plating liquid. In the latter sequence of steps, a majority of the oxidation-prone metal stays in the plating liquid, while the protective metal is mechanically applied to the metal substrate. When the immersion metal is subsequently added to the plating liquid, the oxidation-prone metal is mechanically plated on the substrate previously coated with protective metal. Subsequent additions of the oxidation-prone metal and the immersion to plating liquid can be used to build up the outer layer of dispersed immersion metal and oxidation-prone metal.

Immersion metal alone can be applied on the layer of dispersed oxidation-prone metal and immersion metal surrounding the layer of protective metal by adding immersion metal to the plating liquid and agitating the plating liquid. Such addition of immersion metal alone can surround each particle or aggregate of dispersed immersion metal and oxidation-prone metal. More additions and agitation effects a build-up of the immersion metal.

Instead of applying immersion metal around the layer of dispersed oxidation-prone metal and immersion metal, a layer of dispersed oxidation-prone metal and immersion metal can be built up by adding more immersion metal and oxidation-prone metal to the plating liquid.

In all these coating alternatives, adjacent layers of the oxidation-prone metal, the protective metal, and/or the immersion metal will tend to diffuse into one another. While not wishing to be bound by theory, it is believed that this diffuse boundary is caused by the continued plating of residual metal powder for one layer in the plating barrel when metal powder for the next layer is added and begins to be plated.

EXAMPLE 1

A one-third cubic foot capacity plating barrel was charged with five square feet of carbon steel nails, 4,000 gram of glass impaction spheres (0.01 to 0.2 inch diameter range), and sufficient water to cover the nails and impaction media. The nails were cleaned, degreased, and copper flashed in accordance with the method set forth in the '315 patent. A solution of 0.64 grams of sodium sulfate, 6.4 grams of tin oxide, 5.0 grams of $NH_4F.HF$, a corrosion inhibitor, and a dispersant were added to the barrel. The barrel was rotated for about two minutes to dissolve all ingredients. Thereafter, 25 grams of aluminum powder was added to the barrel, and the barrel was rotated for five minutes. Three (3) grams of copper sulfate was then added to the barrel, and rotation continued for twenty five minutes.

The nails were removed from the barrel and rinsed with water. A shiny metallic coating was observed on the nails. Cross-sectioning of the nails and analysis by energy dispersive x-ray techniques showed the coating to consist of 80% aluminum, 3% copper, 12% tin, and 5% iron. Plating efficiency was 60%.

The coated nails were subjected to a salt spray corrosion test (ASTM B117) and were found to withstand 72–86 hours of salt spray before significant corrosion was observed. Nails which were chromated withstood 1,000 hours of salt spray before significant corrosion was observed.

EXAMPLE 2

Example 1 was repeated using 10 grams of $K_2ZrF_6$ as the etching agent in place of the ammoniated fluoride. Similar results were obtained.

EXAMPLE 3

Example 1 was repeated using 0.5 grams of sodium fluoride as the etching agent. Corrosion resistance of about 300 hours in salt spray was observed;

EXAMPLE 4–7

Using the process of Example 1 with the fluoride etching agent of Example 3, varying quantities of aluminum, tin, and copper were employed in the mechanical plating liquid, and the resulting coated nails were analyzed for content of the coating. The results are set forth below in Table 1.

TABLE 1

| | Reactant(grams) | | | Coating Composition (wt. %) | | |
|---|---|---|---|---|---|---|
| Example | Al | $CuSO_4$ | SnO | Al | Cu | Sn |
| 4 | 25 | 10 | 2.3 | 80 | 10 | 10 |
| 5 | 25 | 3 | 9.3 | 55 | 5 | 40 |
| 6 | 25 | 3 | 2.3 | 83 | 9 | 8 |
| 7 | 25 | 10 | 9.3 | 65 | 15 | 20 |

EXAMPLE 8

2500 grams of 1 inch Phillips head screws were cleaned, coppered, and-tinned in accordance with the '315 patent. Two portions of cadmium powder (10.5 grams each) were then added to the barrel at 5 minute intervals. Five minutes after the last addition, 2 portions of 10 grams of aluminum powder together with 3.5 grams of ammonium bifluoride and 2.5 grams of stannous oxide were added to the barrel.

During the aluminum additions, the pH was maintained below 2 by adding 20% sulfuric acid at 5 minute intervals. Five minutes following the last addition, 3 grams of cupric sulfate was added, and the barrel was rotated an additional 10 minutes. The screws were removed from the barrel and rinsed with water. The coated nails were subjected to a salt spray corrosion test (ASTM B117) and were found to withstand 96 hours of salt spray before significant corrosion was observed. Screws which were chromated withstood 3,816 hours before red rust was observed.

EXAMPLE 9

Example 8 was repeated using a mixture of zinc and cadmium powders (1:1 by weight, 9.7 grams for each addition).

The screws were found to withstand 96 hours of being sprayed with a 5% neutral salt spray (ASTM B117) before significant corrosion was observed. Screws which were chromated withstood 4,536 hours of salt spray until the first red rust was observed.

EXAMPLE 10

A mixture of 1½ pounds of hex head screws, ½ pound of hex head bolts, and 2 pounds of 6d common nails (3 $ft^2$ total surface area) were cleaned, coppered, and tinned according to example 8. Zinc (3 portions of 8 grams each) was then added at 3 minute intervals. Three minutes after the last zinc addition, a mixture of aluminum powder (10 grams), ammonium bifluoride (2.5 grams) and stannous oxide (3.5 grams) were added to the barrel which was rotated for 5 minutes. Aluminum (10 grams) and stannous oxide (3.5 grams) were then added, and the barrel was tumbled for 5 minutes.

Finally, cupric sulfate (2.0 grams) was added, and the barrel was rotated an additional 10 minutes. After rinsing and drying, the coated screws were subjected to a neutral salt spray (ASTM B117). The unchromated samples first showed red rust after 168 hours of spraying, while the chromated samples first showed red rust after 3,816 hours.

EXAMPLE 11

Steel Phillips head screws (2.5 kilograms) were cleaned, coppered, and tinned in accordance with the '315 patent. A mixture of zinc powder (8.0 grams), aluminum powder (10.0 grams), ammonium bifluoride (3.6 grams), and stannous oxide (2.4 grams) was added to the barrel which was then allowed to rotate for 5 minutes. Another addition of zinc (3 grams), aluminum (12 grams), and stannous oxide (2.4 grams) was made, and the plating continued for 5 minutes more. During these additions, the pH was maintained below 2 by addition of 20% sulfuric acid. Finally, copper sulfate (2.4 grams) was added, and the barrel was rotated for another 10 minutes. After the parts were separated, rinsed, and dried, they were subjected to 5% neutral salt spray (ASTM B117). Unchromated samples showed no significant rust (i.e. over 10% rust) until 168 hours of spraying had passed. When the samples were chromated, red rust first appeared after 504 hours, but only 5% red rust appeared after 2,500 hours exposure.

EXAMPLE 12

Steel Phillips head screws were either coated with zinc, aluminum on zinc, aluminum on cadmium, or aluminum codeposited with zinc to the thicknesses set forth in Table below. The coated screws were subjected to a 5% neutral salt spray to determine how long it took before there was significant rust (i.e. over 10% rust). As shown below in Table 1, coatings of zinc were inferior to coatings of aluminum on zinc, aluminum on cadmium, and aluminum codeposited with zinc, applied in accordance with the present invention.

TABLE 1

| Coating | Thickness (mils) | Hours to 10% Red Rust |
|---|---|---|
| Zinc | 0.3 | 384 |
| Zinc | 0.6 | 504 |
| Zinc | 0.9 | 624 |
| Al on Zinc | 0.6 | >2000 |
| Al on Cadmium | 0.6 | >2000 |
| Al:Zn codeposited | 0.5 | >2000 |
| Al:Zn codeposited | 0.6 | >2000 |

This superior salt spray corrosion resistance of substrates coated with aluminum on zinc, aluminum on cadmium, or aluminum codeposited with zinc, however, do not carry over to the environment utilized in the Kestnernich Test where coated substrates are cyclically subjected to sulfurous acid. As shown in Table 2, zinc or cadmium coated screws are able to withstand as many or more cycles of being subjected to sulfurous acid than are screws coated with aluminum on cadmium, aluminum on zinc, or codeposited aluminum and zinc, all chromated.

TABLE 2

| Coating | Thickness | Cycles to 10% Red Rust |
|---|---|---|
| Zinc | | >20 |
| Cadmium | | 14 |
| Al on Cd | 0.6 | 11 |
| Al on Zn | 0.6 | 15 |
| Al:Zn codeposited | 0.6 | 14 |

EXAMPLE 13

Two inch bolt-nut assemblies were coated with zinc, aluminum on zinc, or aluminum codeposited with zinc to the thicknesses set forth below in Table 3. These assemblies were then fastened to a panel of aluminum and subjected to a 5% neutral salt spray to determine how many hours it took until the assemblies had significant rust (i.e over 10% rust) and until pitting of the aluminum panel was first noticed As shown below in Table 3, the assemblies coated with zinc were severely corroded, and the aluminum panels to which the zinc coated assemblies were attached were severely pitted as a result of galvanic corrosion. By contrast, the assemblies plated with codeposited aluminum and zinc or aluminum on zinc had virtually no corrosion, while the aluminum panels to which these assemblies are attached had little bitting.

TABLE 3

| Coating | Hours Until 10% Red Rust Appeared On Assemblies | | Hours Until Pitting Damage To Aluminum Panel was First Noticed |
|---|---|---|---|
| Zinc (Chromated) | 0.35 | 264 | 144 |
| | 0.6 | 384 | 288 |
| Al:Zn codeposited | 0.35 | >1104 | 1008 |
| Al:Zn codeposited | 0.60 | >1536 | 1008 |
| Al on Zn | 0.60 | >1536 | 1008 |

Although the invention has been described in detail for the purpose of illustration, it is understood that such detail is solely for that purpose, and variations can be made therein by those skilled in the art without departing from the spirit and scope of the invention which is defined by the following claims.

What is claimed:

1. A process of mechanically plating a metal substrate comprising the steps of:

providing an acidic plating liquid containing said metal substrate and an impaction media; and thereafter carrying out at least one sequence of the steps of:

adding to said acidic plating liquid particulate aluminum, an immersion metal compound, in an amount which will permit immersion metal in its metallic state to coat the aluminum particles to prevent the aluminum from oxidizing, and an etching agent, in an amount effective to remove surface oxides from the particulate aluminum, the immersion metal compound and the etching agent being added in amounts to permit the aluminum to be mechanically plated onto said metal substrate; and agitating the acidic plating liquid, whereby said impaction media strikes said metal substrate and causes the particulate aluminum coated with the immersion metal in its metallic state to adhere to said metal substrate as a mechanically plated coating having a thickness of 0.1 to 5.3 mils.

2. A process according to claim 1, wherein said adding further comprises:

adding a protective metal to said acidic plating liquid to prevent oxidation of said metal substrate.

3. A process according to claim 2, wherein said agitating is continuous..

4. A process according to claim 2, wherein said agitating is intermittent.

5. A process according to claim 2, wherein the aluminum is more prone to oxidation than the protective metal.

6. A process according to claim 5, wherein the protective metal is selected from the group consisting of zinc, cadmium, and mixtures thereof.

7. A process according to claim 6, wherein the protective metal is zinc and the weight ratio of the zinc to the aluminum is 1:99 to 99:1.

8. A process according to claim 7, wherein the weight ratio of zinc to aluminum is 1:4 to 4:1.

9. A process according to claim 2, wherein said adding further comprises:

adding the etching agent to said acidic plating liquid.

10. A process according to claim 9, wherein said etching agent is a fluoride compound.

11. A process according to claim 10, wherein the concentration of the fluoride compound in the acidic plating liquid is 1.0 to 30 wt. % based on the weight of the aluminum.

12. A process according to claim 11, wherein the fluoride compound etching agent has an instability constant smaller than fluorides of the immersion metal compound but larger than fluorides of the aluminum.

13. A process according to claim 12, wherein the fluoride compound is selected from the group consisting of alkali metal fluorides, ammoniated fluorides, intermetallic fluorides, and mixtures thereof.

14. A process according to claim 9, wherein said adding the etching agent occurs after, and/or during said adding the aluminum, the protective metal, and/or the immersion metal compound.

15. A process according to claim 2, wherein the aluminum, the protective metal, and the immersion metal compound are added to the acidic plating liquid in quantities such that the coating comprises at least 65 wt. % of the aluminum.

16. A process according to claim 2, wherein said adding and said agitating comprises:

adding the protective metal to the acidic plating liquid containing the metal substrate and the impaction media;

agitating the acidic plating liquid;

adding the aluminum, the etching agent, and the immersion metal compound together to the acidic plating liquid to which the protective metal was previously added; and agitating the acidic plating liquid.

17. A process according to claim 16, wherein said adding and said agitating further comprises:

adding more of the immersion metal compound to the acidic plating liquid to which the aluminum, the etching agent, and the immersion metal compound were together previously added and agitating the acidic plating liquid.

18. A process according to claim 16, wherein said adding and said agitating further comprises:

adding to the acidic plating liquid after said adding the aluminum, the etching agent, and the immersion metal compound together, more of the aluminum and more of the immersion metal compound together and agitating the acidic plating liquid.

19. A process according to claim 2, wherein said adding and said agitating comprises:

adding together the protective metal, the aluminum, the etching agent, and the immersion metal compound to the acidic plating liquid containing the metal substrate and the impaction media;

agitating the acidic plating liquid;

adding together more of the protective metal, the aluminum, and the immersion metal compound to the acidic plating liquid to which the protective metal, the aluminum, the etching agent, and the immersion metal compound were previously added;

agitating the acidic plating liquid;

adding more immersion metal compound to the acidic plating liquid to which the protective metal, the aluminum, and the immersion metal compound were together previously added; and agitating the acidic plating liquid.

20. A process according to claim 2, wherein the protective metal is more anodic on the galvanic series than iron.

21. A process of mechanically plating a metal substrate comprising the steps of:

(a) contacting said metal substrate with an acidic solution to clean and descale the surfaces of said metal substrate;

(b) rinsing said metal substrate with water;

(c) adding a surface conditioner containing strong acid to an agitated plating barrel containing impaction media and said metal substrate to maintain the surfaces of said metal substrate clean and oxide-free;

(d) without intermediate rinsing, adding to the agitated plating barrel a coppering agent which forms a thin copper coating on the clean, oxide-free surfaces of said metal substrate;

(e) without intermediate rinsing, adding to said agitated plating barrel a metal salt more noble than the ultimate plating metal and a small quantity of metal to flash coat the coppered surfaces of said substrate with said more noble metal; and thereafter carrying out, at least once, the step of:

(f) without intermediate rinsing, adding to said agitated plating barrel particulate aluminum, an immersion metal compound in an amount which will permit immersion metal in its metallic state to coat the aluminum to prevent the aluminum from oxidizing, a protective metal to prevent oxidation of said metal substrate, and an etching agent, in an amount effective to remove surface oxides from the particulate aluminum, the immersion metal compound and the etching agent being added in amounts to permit the aluminum to be mechanically plated onto said metal substrate, whereby said impaction media causes said protective metal, said immersion metal in its metallic state, and the aluminum to adhere to the coppered and more noble metal coating on the surfaces of said metal substrate as a mechanically plated layer, having a thickness of 0.1 to 5.3 mils.

22. A process of mechanically plating a metal substrate comprising the steps of:

pretreating particulate aluminum with an immersion metal compound, in an amount which will permit immersion metal in its metallic state to coat the particulate aluminum to prevent the aluminum from oxidizing, and an etching agent, in an amount effective to remove surface oxides from the particulate aluminum, the immersion metal compound and the etching agent being added in amounts to permit the aluminum to be mechanically plated;

providing an acidic plating liquid containing said metal substrate and an impaction media;

adding to said acidic plating liquid said pretreated, particulate aluminum; and agitating the acidic plating liquid, whereby said impaction media strikes said metal substrate and causes the pretreated, particulate aluminum to adhere to said metal substrate as a coating.

23. A process according to claim 22, wherein said adding further comprises:

adding a protective metal to said plating liquid to prevent oxidation of said metal substrate.

24. A process according to claim 23, wherein said agitating is continuous.

25. A process according to claim 23, wherein said agitating is intermittent.

26. A process according to claim 23, wherein the aluminum is more prone to oxidation than the protective metal.

27. A process according to claim 26, wherein the protective metal is selected from the group consisting of zinc, cadmium, and mixtures thereof.

28. A process according to claim 27, wherein the protective metal is zinc, and the weight ratio of zinc to aluminum is 1:99 to 99:1.

29. A process according to claim 28, wherein the weight ratio of zinc to aluminum is 1:4 to 4:1.

30. A process according to claim 23, wherein said etching agent is a fluoride compound.

31. A process according to claim 30, wherein the fluoride compound etching agent has an instability constant smaller than fluorides of the immersion metal but larger than fluorides of the aluminum.

32. A process according to claim 31, wherein the fluoride compound is selected from the group consisting of alkali metal fluorides, ammoniated fluorides, intermetallic fluorides, and mixtures thereof.

33. A process according to claim 23, wherein the pretreated, particulate aluminum and the protective metal are added to the acidic plating liquid in quantities such that the coating comprises at least 65 wt. % of the aluminum.

34. A process according to claim 23, wherein the protective metal is more aniodic on the galvanic series than iron.

35. A process of mechanically plating a metal substrate comprising the steps of:

pretreating particulate aluminum with an immersion metal compound, in an amount which will permit immersion metal in its metallic state to coat the particulate aluminum to prevent the aluminum from oxidizing, and an etching agent, in an amount effective to remove surface oxides from the particulate aluminum, the immersion metal compound and the etching agent being added in amounts to permit the aluminum to be mechanically plated;

(b) contacting said metal substrate with an acidic solution to clean and descale the surfaces of said metal substrate;

(c) rinsing said metal substrate with water;

(d) adding a surface conditioner containing strong acid to an agitated plating barrel containing impaction media and said metal substrate to maintain the surfaces of said metal substrate clean and oxide-free.

(e) without intermediate rinsing, adding to the agitated plating barrel a coppering agent which forms a thin copper coating on the clean, oxide-free surfaces of said metal substrate;

(f) without intermediate rinsing, adding to said agitated plating barrel a metal salt more noble than the ultimate plating metal and a small quantity of metal to flash coat the coppered surfaces of said substrate with said more noble metal; and (g) without intermediate rinsing, adding to said agitated plating barrel the pretreated, particulate aluminum and a protective metal to prevent oxidation of said metal substrate, whereby said impaction media causes said protective metal and the pretreated, particulate aluminum to adhere to the coppered and more noble metal coating on the surfaces of said metal substrate as a plating layer.

* * * * *